US005331891A

United States Patent [19]

Sugiyama et al.

[11] Patent Number: 5,331,891

[45] Date of Patent: Jul. 26, 1994

[54] PRINTING CYLINDER/ROLLER CLEANING APPARATUS FOR PRINTING PRESS AND METHOD OF CLEANING PRINTING CYLINDER/ROLLER

[75] Inventors: Hiroyuki Sugiyama; Toshihiko Ebina, both of Ibaraki, Japan

[73] Assignee: Komori Corporation, Tokyo, Japan

[21] Appl. No.: 6,640

[22] Filed: Jan. 21, 1993

[30] Foreign Application Priority Data

Jan. 22, 1992 [JP] Japan ..... 4-6274[U]
Jan. 22, 1992 [JP] Japan ..... 4-6275[U]
Jan. 27, 1992 [JP] Japan ..... 4-34053

[51] Int. Cl.[5] ..... B41F 35/00
[52] U.S. Cl. ..... 101/424; 101/425
[58] Field of Search ..... 101/424, 423, 425

[56] References Cited

U.S. PATENT DOCUMENTS 2,751,616 6/1956 Turner, Jr. et al. ..... 101/425
4,015,307 4/1977 Kossak ..... 101/425
4,555,989 12/1985 Marass et al. ..... 101/424
4,887,531 12/1989 Ichikawa et al. ..... 101/216
4,901,641 2/1990 Steiner et al. ..... 101/216

FOREIGN PATENT DOCUMENTS 59-178254 10/1984 Japan .
3-224739 10/1991 Japan .

*Primary Examiner*—Edgar S. Burr
*Assistant Examiner*—Anthony H. Nguyen
*Attorney, Agent, or Firm*—Blakely, Sokoloff Taylor & Zafman

[57] ABSTRACT

A printing cylinder/roller cleaning apparatus for a printing press includes a brush roll, a cleaning cloth, a nozzle, and a scraping member. The brush roll is pressed against the circumferential surface of a rotating printing cylinder/roller to scrape contamination therefrom. The cleaning cloth is provided below the brush roll and pressed against the circumferential surface of the printing cylinder/roller to wipe scraped contamination. The nozzle has a plurality of spray holes to spray a solvent onto the brush roll. The scraping member is engaged with a lower end of the brush roll to cause a waste liquid attaching to the brush roll to drop onto the cleaning cloth.

A method of cleaning the printing cylinder/roller is also provided.

10 Claims, 4 Drawing Sheets

PRINTING CYLINDER/ROLLER CLEANING APPARATUS FOR PRINTING PRESS AND METHOD OF CLEANING PRINTING CYLINDER/ROLLER

BACKGROUND OF THE INVENTION

The present invention relates to a printing cylinder/-roller cleaning apparatus in various types of printing presses, which cleans the circumferential surface of a printing cylinder, e.g., a blanket cylinder, an impression cylinder, or a transfer cylinder, and the circumferential surface of a roller, e.g., a form roller or a vibrating roller, and a method of cleaning the printing cylinder/-roller.

Each of various types of printing presses, e.g., an offset printing press and an intaglio printing press, has printing cylinders, e.g., a plate cylinder, a blanket cylinder, an impression cylinder, and a transfer cylinder, and rollers, e.g., a form roller and a vibrating roller. During the printing operation, foreign matters, e.g., ink dust and paper dust are attached to the circumferential surfaces of these printing cylinders and rollers to degrade the quality of the printed matter. Hence, a cleaning apparatus is provided for cleaning the printing cylinders and rollers to remove the foreign matters.

As an example of a printing cylinder/roller cleaning apparatus of this type, for example, an apparatus for cleaning the blanket cylinder disclosed in Japanese Patent Laid-Open No. 59-178254 is known. This apparatus has rewinding and take-up shafts. The rewinding and take-up shafts are close to the circumferential surface of the blanket cylinder and extend in the axial direction thereof. The two end portions of each of the rewinding and take-up shafts are rotatably axially supported by the bearings of the apparatus frame. One or two guide rollers are provided at the intermediate portion of each of these shafts. When the take-up shaft is driven by a driving unit to be intermittently rotated by a predetermined angle, a cleaning cloth, e.g., an unwoven fabric which is taken up on the rewinding shaft in a separate process is intermittently rewound from the rewinding shaft, is pressed by the guide roller against the circumferential surface of the blanket cylinder, and is taken up on the take-up shaft. A brush roller is provided above the traveling path of the cleaning cloth extending from the guide roller toward the take-up shaft to contact the circumferential surface of the blanket cylinder. The brush roller and the blanket cylinder are rotated in the same direction so that their peripheral rotational directions at the contact portions are opposite to each other. A nozzle for spraying a cleaning liquid toward the brush roller is provided above the brush roll. A reception pan (collecting tub) for collecting a waste liquid and the like is provided below the brush roll.

However, in the conventional cleaning apparatus described above, since the foreign matters and the waste cleaning liquid removed from the blanket cylinder are discharged to the reception pan, treatment of the waste liquid and the like accumulated in the reception pan and cleaning of the reception pan must be frequently performed. This increases the load of the operator and prolongs the preparation time, thus degrading the operability of the printing press. In the printing cylinder/-roller cleaning apparatus disclosed in Japanese Patent Laid-Open No. 3-224739, in addition to the reception pan described above, a recovery unit is provided to be connected to the reception pan for removing the accumulated waste liquid and the like through a hose. However, with this arrangement, since the apparatus is complicated and its size is increased, the apparatus cannot be provided at a low cost.

Since the cleaning liquid from the spray hole of the nozzle is sprayed to one portion locally, cleaning non-uniformity is caused to be transferred from the brush roller to the blanket cylinder again, so that a sufficient cleaning result cannot be obtained. In order to solve this problem, an apparatus using a special nozzle is proposed. In this apparatus, a plurality of branch pipes are formed to extend from the nozzle, and the cleaning liquid is sprayed from holes formed in the branch pipes. Alternatively, another apparatus is proposed. In this apparatus, predetermined amounts of solvent and air are supplied to the piping path of the nozzle, so that the solvent is sprayed like a mist from the spray hole. However, in the former apparatus using such a special nozzle, since a large number of branch pipes are provided, the manufacturing cost is increased, the number of assembling steps is increased, and it is difficult to seal the branch pipes to prevent liquid leakage. In the latter apparatus for spraying the solvent like a mist, since air pipes must be provided in addition to solvent pipes, the manufacturing cost including the control system for the air and solvent pipes is increased, and wiring and piping operations become cumbersome. In addition, since the solvent is sprayed like a mist, it is scattered around to worsen the working atmosphere.

Furthermore, since the cleaning cloth pressed by the guide roller and the brush roller are pressed against the circumferential surface of the blanket cylinder simultaneously, when the cleaning cloth contacts the blanket cylinder for the first time, the cleaning cloth adhesively attaches to the circumferential surface of the blanket cylinder by the accumulated ink tack, thus damaging the cleaning cloth.

SUMMARY OF THE INVENTION

It is an object of the present invention to provide a printing cylinder/roller cleaning apparatus for a printing press, which does not need a reception pan for a waste liquid and the like.

It is another object of the present invention to provide a printing cylinder/roller cleaning apparatus for a printing press, which enables treatment of the waste liquid and the like with a simple structure, and a method of cleaning the printing cylinder/roller.

It is still another object of the present invention to provide a printing cylinder/roller cleaning apparatus for a printing press, in which a solvent is uniformly sprayed to a brush roller, and a method of cleaning the printing cylinder/roller.

It is still another object of the present invention to provide a printing cylinder/roller cleaning apparatus for a printing press, which can effectively perform cleaning with a simple structure, and a method of cleaning the printing cylinder/roller.

It is still another object of the present invention to provide a printing cylinder/roller cleaning apparatus for a printing press, in which damage to a cleaning cloth is prevented, and a method of cleaning the printing cylinder/roller.

In order to achieve the above object, according to an aspect of the present invention, there is provided a printing cylinder/roller cleaning apparatus for a printing press, comprising a brush roller, pressed against a circumferential surface of a rotating printing cylinder/roller, for scraping contamination therefrom, a cleaning cloth, provided below the brush roller and pressed against the circumferential surface of the printing cylinder/roller, for wiping scraped contamination, a nozzle having a plurality of spray holes for spraying a solvent onto the brush roll, and a scraping member, engaged with a lower end of the brush roller, for causing a waste liquid attaching to the brush roller to drop onto the cleaning cloth.

According to another aspect of the present invention, there is provided a method of cleaning a printing cylinder/roller of a printing press, comprising the steps of pressing a brush roller against a circumferential surface of a rotating printing cylinder/roller, pressing a cleaning cloth against the circumferential surface of the printing cylinder/roller, cleaning the circumferential surface of the printing cylinder/roller by rotating the brush roller in an opposite direction to that of the printing cylinder/roller and taking up the cleaning cloth, after cleaning is ended, moving the brush roller away from the circumferential surface of the printing cylinder/roller, and moving the cleaning cloth away from the circumferential surface of the printing cylinder/roller.

DESCRIPTION OF THE PREFERRED EMBODIMENT

Figure 1:
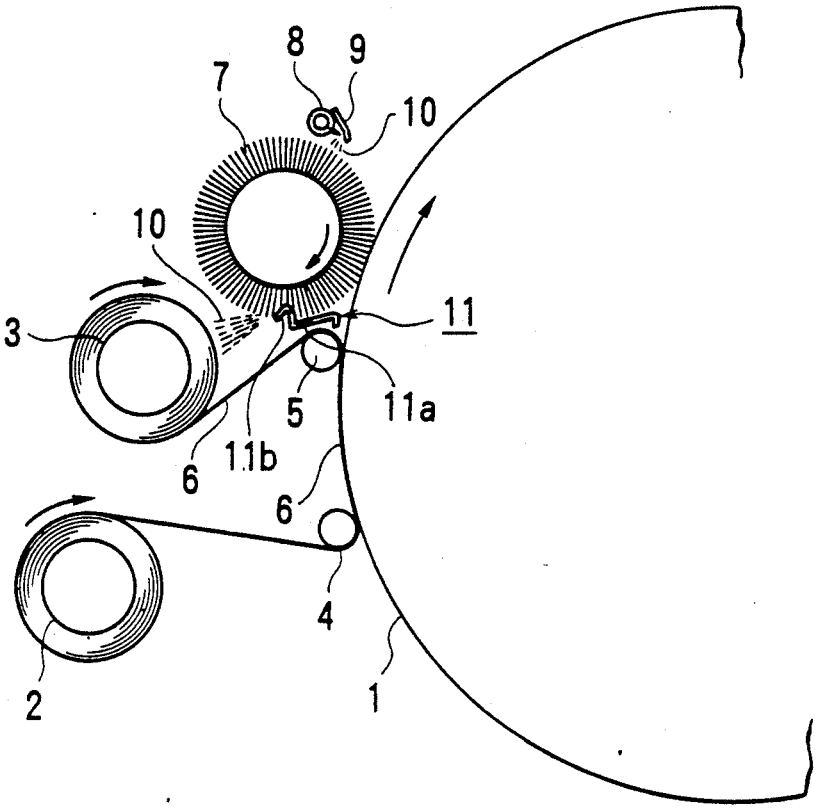
FIG. 1 is a schematic side view of a printing cylinder/roller cleaning apparatus for a printing press according to an embodiment of the present invention.
Figure 2:
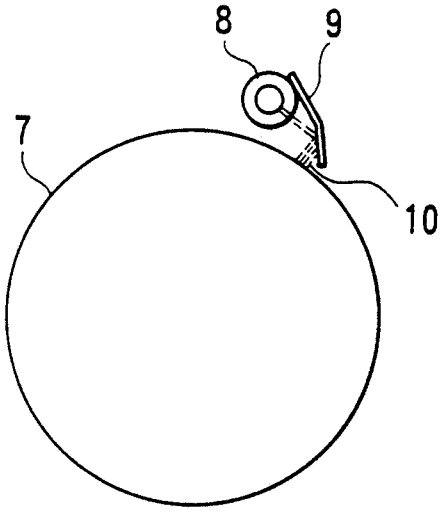
FIG. 2 is an enlarged side view of a portion including a nozzle and a reflecting plate shown in FIG. 1.

A preferred embodiment of the present invention will be described with reference to the accompanying drawings. FIG. 1 shows a printing cylinder/roller cleaning apparatus according to an embodiment of the present invention, and FIG. 2 shows a portion including a nozzle and a reflecting plate. Referring to FIGS. 1 and 2, a hollow supply shaft 2 and a hollow take-up shaft 3 are disposed in the vicinity of a blanket cylinder 1. The supply and take-up shafts 2 and 3 extend in the axial direction of the blanket cylinder 1, and each of them has two end portions rotatably and detachably supported by the support portions of the apparatus frame (not shown). A pair of guide rollers 4 and 5 each having two end portions rotatably axially supported by the bearings of the apparatus frame are pressed against the circumferential surface of the blanket cylinder 1 through a cleaning cloth 6.

The belt-like cleaning cloth 6 constituted by, e.g., an unwoven fabric is fully wound on the supply shaft 2 in a separate process, and the rewinding shaft 2 is mounted on the apparatus frame. The cleaning cloth 6 wound on the supply shaft 2 is guided to the guide roller 4 and then to the take-up shaft 3 through the guide roller 5. The take-up shaft 3, which is initially mounted on the apparatus frame in an empty state, is intermittently rotated as it is driven by a driving unit (not shown), so that it intermittently takes up the cleaning cloth 6 guided from the guide roller 5, as shown in FIG. 1.

A brush roller 7 constituted by a hollow central shaft and a large number of bristles or filling standing upward from the circumferential surface thereof is rotatably axially provided above the traveling path of the cleaning cloth 6 extending from the guide roller 5 toward the take-up shaft 3. The ends of the bristles are pressed against the circumferential surface of the blanket cylinder 1. The brush roller 7 is rotated in the same direction as the blanket cylinder 1, as indicated by an arrow in FIG. 1, such that the peripheral rotational direction of its circumferential surface is opposite to that of the blanket cylinder 1. Then, the foreign matters, e.g., ink dust and paper dust attaching to the circumferential surface of the blanket cylinder 1 are reliably scraped by the brush roller 7.

Reference numeral 8 denotes a spray nozzle coupled to a solution container (not shown) through a pipe or the like. A large number of spray holes having an obliquely downward spraying direction are formed in the lower portion of the spray nozzle 8. A reflecting plate 9 having substantially the same length as that of the spray nozzle 8 is fixed to the spray nozzle 8. With this arrangement, when a pump (not shown) or the like is rotated, a solution 10 is sprayed from the large number of spray holes and abutted against the reflecting plate 9. The solution 10 is deflected and diffused, and uniformly sprayed in the different directions toward the brush roller 7.

Furthermore, a stationarily supported bent plate-like scraping member 11 is provided below the brush roller 7 such that its bent piece **11*b* is engaged with the filling of the rotating brush roller 7. The scraping member 11 thrusts through the filling to drop the foreign matters and waste liquid attaching to the filling onto the cleaning cloth 6 traveling below the brush roller 7. A hole 11*a* for discharging the waste liquid and the like therethrough is formed in the bottom portion of the scraping member 11**.

The operation of the printing cylinder/roller cleaning apparatus having the arrangement as described above will be described in detail. The cleaning cloth 6 is rewound from the supply shaft 2 and is pressed by the guide rollers 4 and 5 against the circumferential surface of the blanket cylinder 1. The take-up shaft 3 is intermittently rotated to take up the cleaning cloth 6. When the blanket cylinder 1 and the brush roller 7 are rotated such that their contacting circumferential surfaces are rotated in the opposite directions, as indicated by the arrows in FIG. 1, the foreign matters attaching to the circumferential surface of the blanket cylinder 1 are wiped with and removed by the cleaning cloth 6 between the guide rollers 4 and 5, and is simultaneously scraped by the brush roller 7.

At this time, when the solution 10 is sprayed from the spray holes of the spray nozzle 8, the sprayed solution 10 is abutted against the reflecting plate 9 to be deflected and diffused, and is uniformly sprayed to the respective portions of the brush roller 7. As a result, the solution 10 can be uniformly supplied to the circumferential surface of the blanket cylinder 1, and the foreign matters scraped by the brush roller 7 are reliably dissolved in the solution 10 and attach to the filling of the brush roller 7 together with the waste liquid. The scraping member 11 below the brush roller 7 thrusts through the filling by engaging its bent piece 11*b* with the filling of the brush roller 7. Hence, the foreign matters and waste liquid attaching to the filling of the brush roller 7 drop from the hole 11*a* of the scraping member 11 and the distal end portion of the bent piece 11*b* onto the cleaning cloth 6. The dropped foreign matters and waste liquid are received by and permeate through the cleaning cloth 6, and the cleaning cloth 6 is taken up by the take-up shaft 3 while it is impregnated with the foreign matters and waste liquid. That is, since the filling of the brush roller 7 is forcibly thrust by the scraping member 11, removal of the foreign matters and waste liquid is promoted.

When this cleaning is repeated until the cleaning cloth 6 on the supply shaft 2 runs out, the empty supply shaft 2 is replaced with a supply shaft 2 on which a cleaning cloth 6 is fully wound in a separate process. Simultaneously, the take-up shaft 3 on which the contaminated cleaning cloth 6 is wound is removed and the used cleaning cloth 6 is disposed of. An empty take-up shaft 3 is mounted on the apparatus, and a new cleaning cloth 6 is pulled from the supply shaft 2 and wound on the empty take-up shaft 3.

Figure 3:
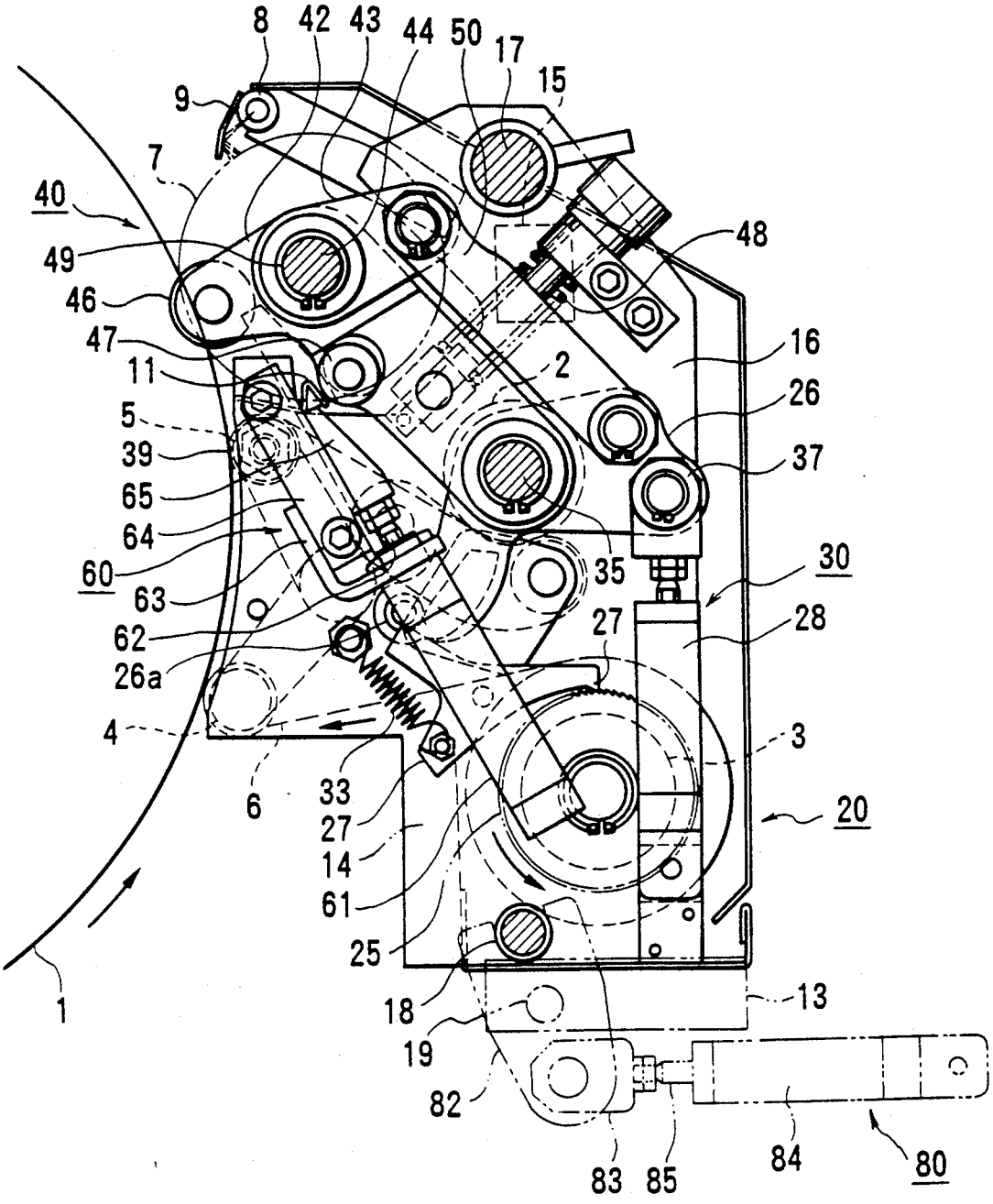
FIG. 3 is a side view for explaining in detail the driving mechanism of the printing cylinder/roller cleaning apparatus for the printing press shown in FIG. 1.
Figure 4:
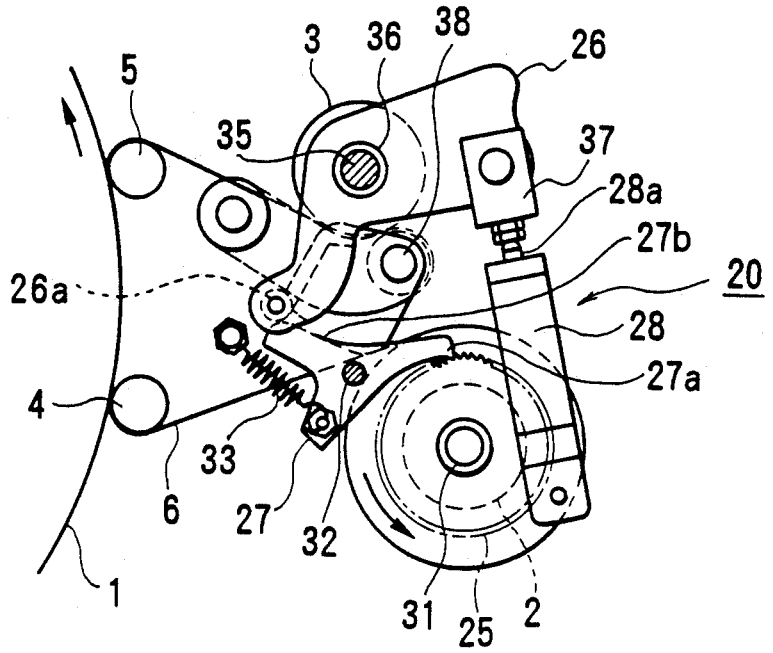
FIG. 4 is a side view of the main part of the printing cylinder/roller cleaning apparatus for the printing press shown in FIG. 1 for explaining the driving mechanism thereof.

FIG. 3 shows in detail the driving mechanism of the printing cylinder/roller cleaning apparatus for the printing press shown in FIG. 1, FIG. 4 shows the main part thereof, and FIGS. 5A to 5E explain the cleaning method. Referring to FIGS. 3 to 5E, a fulcrum pin 17 serving as the pivot center of a cleaning unit 20, and a roller 18 and a fulcrum pin 19 for supporting the cleaning unit 20 on the printing press are provided on a pair of side frames 16 fixed by stays 14 and 15. The roller 18 is guided by a guide 13 in the right-to-left direction in FIG. 3.

The cleaning unit 20 consists of a cleaning cloth take-up mechanism 30, a brush roller mechanism 40, and a first driving means 60 for singularly driving the brush roller mechanism 40. As is shown in detail in FIG. 4, the cleaning cloth take-up mechanism 30 schematically comprises the supply shaft 2, the take-up shaft 3, the pair of guide rollers 5 and 6, a ratchet wheel 25 pivotally coaxially mounted on the supply shaft 2, a swing lever 26 swingably coaxially mounted on a shaft 35 of the take-up shaft 3, a lock lever 27 swingably supported on a shaft 32, and an air cylinder 28. These components are supported on the cleaning unit 20.

The supply shaft 2 is connected to the ratchet wheel 25 through a one-way clutch 31 whose rotation in a direction to supply the cleaning cloth 6 to the take-up shaft 3 is prohibited. A ratchet 27*a* is formed on one end of the lock lever 27, and a cam surface 27*b* is formed on the upper end surface of the lock lever 27. The lock lever 27 is normally swung by a spring 33 clockwise in FIG. 4, and the ratchet 27*a* is engaged with the ratchet wheel 25. The take-up shaft 3 is connected to the swing lever 26 through a one-way clutch 36 which is rotatable only in a direction to take up the cleaning cloth 6 on the take-up shaft 3.

A guide roller 26*a* slidable on the cam surface 27*b* of the lock lever 27 is provided on one end of the swing lever 26. The air cylinder 28 is provided with a reciprocal rod 28*a*. The rod 28*a* and the other end of the swing lever 26 are coupled to each other through a connection block 37. Reference numeral 38 denotes a stopper pin for regulating the counterclockwise swing movement of the swing lever 26 upon being abutted against the swing lever 26. Reference numeral 39 denotes a guide roller pivotally coaxially supported on the guide roller 5. The guide roller 39 has a diameter slightly larger than that of the guide roller 5 and is pressed against the bearers of the blanket cylinder 1. The cleaning cloth 6 supplied from the supply shaft 2 is extended through the pair of guide rollers 5 and 6 and taken up by the take-up shaft 3.

The brush roller 7 partly constituting the brush roller mechanism 40 is disposed downstream the guide roller 5 and rotatably axially supported by a shaft 44. An L-shaped lever 42 has one end swingably supported on the shaft 35, and the shaft 44 has one end axially mounted on the other end of the L-shaped lever 42. The L-shaped lever 42 is biased by a compression spring 48 counterclockwise so as to pivot about the shaft 35, so that the brush roller 7 is biased toward the blanket cylinder 1. Two rollers 46 and 47 are rotatably supported at the distal end and central portion of the L-shaped lever 42. The peripheral end of the roller 46 projects from the peripheral end of the brush roller 7. The brush roller 7 is connected to another lever 43 through a one-way clutch 49 which is rotatable only counterclockwise in FIG. 3.

One end of the lever 43 is coupled to one end of a link 50, and the other end of the link 50 is coupled to the swing lever 26. The first driving means 60 comprises an air cylinder 61 having a reciprocal rod 62, a bracket 63 for fixing the air cylinder 61, a guide 64 fixed to the bracket 63, and a cam 65 vertically guided by the guide 64 and having a lower end portion coupled to the distal end portion of the rod 62. The roller 47 of the L-shaped lever 42 contacts the cam 65. The L-shaped lever 42 is moved, independently of the operation of the cleaning unit 20, close to and away from the blanket cylinder 1 by the cam 65 which is vertically moved as the rod 62 is moved forward and backward.

Reference numeral 80 denotes a second driving means and comprises a connection plate 82, a connection block 83, and an air cylinder 84. The connection plate 82 is swingably supported by the fulcrum pin 19 and has one end engaged with the roller 18. The connection block 83 is coupled to the other end of the connection plate 82. The air cylinder 84 has a reciprocal rod 85 coupled to the connection block 83. When the air cylinder 84 is actuated, the second driving means 80 moves the cleaning unit 20 close to and away from the blanket cylinder 1 with respect to the fulcrum pin 17 as the center.

Figure 5A:
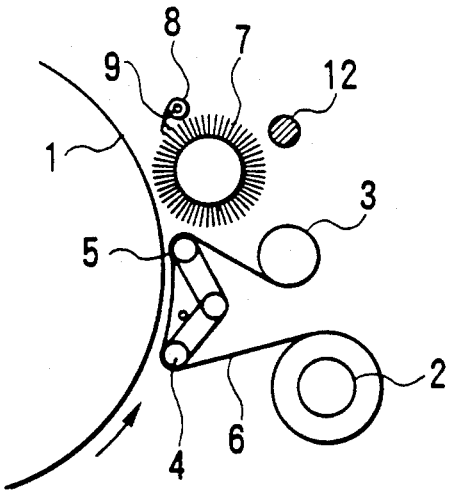
FIGS. 5A to 5E are views showing the cleaning method of the printing cylinder/roller cleaning apparatus for the printing press according to the present invention.
Figure 5B:
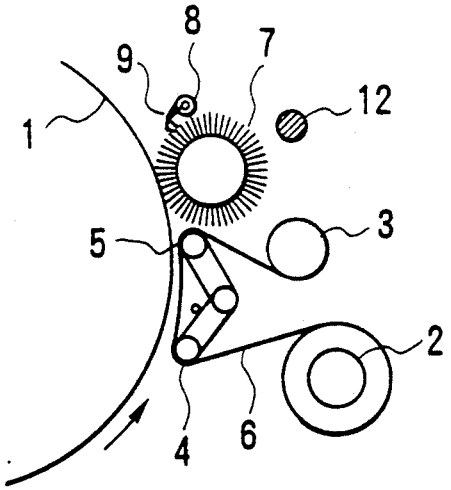

The series of cleaning operation of the blanket cylinder 1 will be described with reference to FIGS. 5A to 5E. Referring to FIG. 5A, the cleaning liquid from the spray nozzle 8 is diffused by the reflecting plate 9 and sprayed toward the brush roller 7. The air cylinder 61 of the first driving means 60 is actuated to retract the rod 62 in the air cylinder 61 and to move the cam 65 downward along the guide 64. Then, the roller 47 slides on the cam 65, the L-shaped lever 42 is swung by the biasing force of the compression spring 48 about the shaft 35 counterclockwise in FIG. 3, and only the brush roller 7 moves close to the circumferential surface of the blanket cylinder 1 rotating as shown in FIG. 5B. At this time, the pair of guide rollers 5 and 6 are away from the circumferential surface of the blanket cylinder 1.

The air cylinder 61 of the first driving means 60 is actuated, and the air cylinder 84 of the second driving means 80 is actuated simultaneously or with a small delay, so that the rod 85 is retracted in the air cylinder 84. Along with this operation, the connection plate 82 is pivoted about the fulcrum pin 19 counterclockwise in FIG. 3, the roller 18 is moved to the left on the guide 13, and the cleaning unit 20 is rotated about the fulcrum pin 17 clockwise in FIG. 3 so as to move close to the circumferential surface of the blanket cylinder 1.

At this time, the brush roller 7 has already moved close to the circumferential surface of the blanket cylinder 1. Hence, the circumferential surface of the brush roller 7 starts to contact the rotating blanket cylinder 1 and gradually increases its contact width until the guide roller 39 contacts the bearers of the blanket cylinder 1. The brush roller 7 scrapes the waste liquid comprising contamination, e.g., the ink dust, paper dust, and the like on the circumferential surface of the blanket cylinder 1 before the cleaning cloth 6 contacts the circumferential surface of the blanket cylinder 1. When the guide roller 39 contacts the bearers of the blanket cylinder 1 to stop movement of the cleaning unit 20 and the cleaning cloth 6 contacts the circumferential surface of the blanket cylinder 1, a cleaning liquid is coated on the circumferential surface of the blanket cylinder 1 and the ink starts to be scraped by the brush roller 7. Thus, since the ink tack on the circumferential surface of the blanket cylinder 1 is already removed, the cleaning cloth will not be damaged by the ink tack, and cleaning can be effectively performed.

Figure 5C:
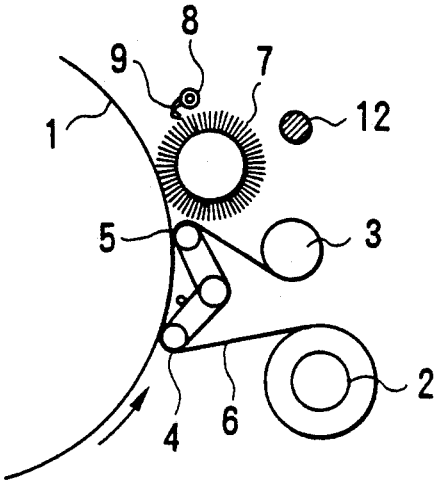

In this state, contamination, e.g., the ink dust and paper dust on the circumferential surface of the blanket cylinder 1 is scraped for several seconds by rotation of the brush roller 7, as shown in FIG. 5C, and remaining contamination is wiped together with the cleaning liquid by taking up the cleaning cloth 6, thereby performing the cleaning operation. This cleaning operation is performed by actuating the air cylinder 28 to move the rod 28*a* forward. When the rod 28*a* is operated, the link 50 is moved upward to swing the lever 43 counterclockwise. The brush roller 7 is rotated counterclockwise, i.e., in the same direction as the blanket cylinder 1 through a predetermined angle through the one-way clutch 49, so that the brush roller 7 is brought into rotatable contact with the circumferential surface of the blanket cylinder 1 in the opposite direction.

As the result of the cleaning operation, contamination, e.g., the ink dust and paper dust attaching to the circumferential surface of the blanket cylinder 1 and scraped by the brush roller 7, and the cleaning liquid attaching to the brush roller 7 are forcibly caused, by the scraping member 11, to drop onto the cleaning cloth 6, after wiping, which extends between the guide roller 5 and the take-up shaft 3, or onto the take-up shaft 3. Therefore, no special collecting tub for collecting the waste liquid and the like is needed or must be cleaned.

The swing lever 26 swings counterclockwise in an interlocked manner with the operation of the rod 28*a* that starts the cleaning operation, and intermittently rotates the take-up shaft 3 counterclockwise in the take-up direction through the one-way clutch 36. That is, when the guide roller 26*a* of the swing lever 26 slides on the cam surface 27*b*, the swing lever 26 causes the lock lever 27 to swing counterclockwise against the spring 33, so that engagement between the ratchet wheel 25 and the ratchet 27*a* is released. Hence, the take-up operation of the take-up shaft 3 for a predetermined length is enabled.

Figure 5D:
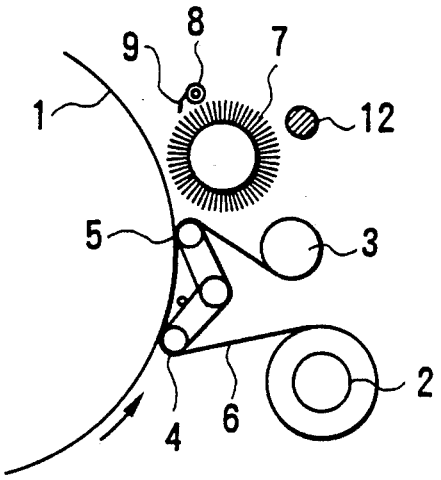

When the cleaning operation is ended, the air cylinder 61 of the first driving means 60 is actuated to move the rod 62 forward from the air cylinder 61, so that the L-shaped lever 42 is swung by the cam 65 clockwise about the L-shaped lever 42, thereby moving only the brush roller 7 away from the blanket cylinder 1, as shown in FIG. 5D. In this state, only the cleaning cloth 6 is pressed against the circumferential surface of the blanket cylinder 1 for several seconds to wipe the circumferential surface of the blanket cylinder 1.

Figure 5E:
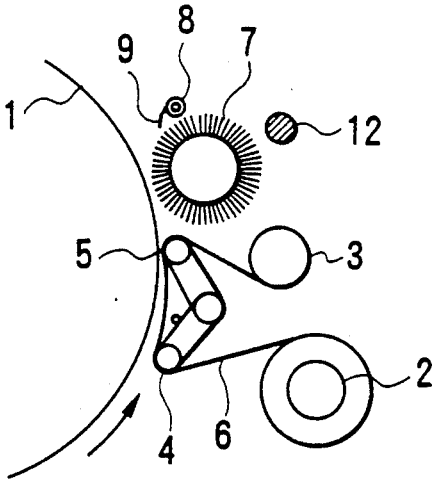

Then, as shown in FIG. 5E, the air cylinder 84 of the second driving means 80 is actuated to move the rod 85 forward from the air cylinder 84. Then, the connection plate 82 is rotated clockwise about the fulcrum pin 19, and the cleaning unit 20 is rotated counterclockwise about the brush roller 7, so that the cleaning cloth 6 is moved away from the blanket cylinder 1.

In this embodiment, the entire cleaning unit 20 is moved by the second driving means 80. However, the present invention is not limited to this, and a similar effect to this can be obtained by moving only the cleaning cloth take-up mechanism 30 by the second driving means 80 to press the cleaning cloth 6 against the blanket cylinder 1. It suffices if a time lag is provided between contact of the brush roller 7 with the blanket cylinder 1 and contact of the cleaning cloth 6 with the blanket cylinder 1. In this embodiment, the second driving means 80 is mounted on the printing press. However, it can be mounted on the cleaning unit 20, as a matter of course.

The air cylinders 28, 61, and 84 are used as the driving means. However, the present invention is not limited to this, and various design modifications are possible including use of a hydraulic cylinder. Also, in this embodiment, the printing cylinder/roller cleaned with the cleaning cloth 6 is the blanket cylinder 1. However, the present invention is not limited to this, and any other printing cylinder or a rotating roller can be cleaned with the cleaning cloth 6.

As has been described above, according to the present invention, the foreign matters on the circumferential surface of the printing cylinder/roller are scraped by the brush roller, dissolved in the solvent, caused to drop on the cleaning cloth, and recovered. Hence, no special reception pan for recovering the waste liquid and the like is needed, thus simplifying the structure. Since treatment of the waste liquid is eliminated, the labor is decreased and the operability of the printing press is improved. Since non-uniformity in cleaning is suppressed by the reflecting plate that diffuses the solvent, the cleaning effect is improved. Since any special nozzle or device for spraying the solvent like a mist need not be provided, unlike in the conventional apparatus, the number of components and the number of assembling steps are decreased. Since the mist-like solvent will not scatter around, the working atmosphere is improved. When the cleaning cloth contacts the printing cylinder/roller, the ink tack has been removed from the circumferential surface of the printing cylinder/roller. Therefore, damage to the cleaning cloth caused by the ink tack can be prevented, thereby effectively performing cleaning. The printing cylinder/roller is wiped with the cleaning cloth after the cleaning operation is ended. Therefore, no contamination, ink, or cleaning agent remains on the printing cylinder/roller.

What is claimed is:

1. A cleaning apparatus in combination with a rotating printing cylinder/roller of a printing press, comprising:

a brush roller, pressed against a circumferential surface of said printing cylinder/roller, for scraping contamination therefrom;

a cleaning cloth, provided below said brush roller and pressed against said circumferential surface of said printing cylinder/roller, for wiping scraped contamination;

a nozzle having a plurality of spray holes for spraying a solvent onto said brush roller; and a scraping member, engaged with a lower end of said brush roller, for causing waste liquid carried by said brush roller to drop onto said cleaning cloth.

2. An apparatus according to claim 1, wherein said scraping member comprises a bent plate having a bent piece to be engaged with said brush roller, and a hole for discharging the waste liquid therethrough is formed in a bottom portion of said bent plate.

3. An apparatus according to claim 1, further comprising a diffusing member for uniformly diffusing the solvent from the spray holes of said nozzle onto said brush roller.

4. An apparatus according to claim 3, wherein said diffusing member comprises a reflecting plate for reflecting the solvent from the spray holes of said nozzle to change a spray direction thereof.

5. An apparatus according to claim 1, further comprising first driving means for moving said brush roller close to and away from said circumferential surface of said printing cylinder/roller, and second driving means for moving said cleaning cloth close to and away from said circumferential surface of said printing cylinder/-roller.

6. An apparatus according to claim 5, further comprising a cleaning unit including said first driving means and said cleaning cloth and swingably supported, and wherein said brush roller is brought into contact with said circumferential surface of said printing cylinder/-roller by said first driving means, and thereafter said second driving means swings said cleaning unit to move said cleaning cloth close to said circumferential surface of said printing cylinder/roller.

7. An apparatus according to claim 5, further comprising a brush roller mechanism for rotating said brush roller, a cleaning cloth take-up mechanism for taking up said cleaning cloth, and a link member for coupling said brush roll mechanism and said cleaning cloth take-up mechanism with each other to rotate said brush roller and take up said cleaning cloth almost simultaneously.

8. An apparatus according to claim 5, wherein at a start of a cleaning operation, said first driving means is operated and thereafter said second driving means is operated, and at an end of the cleaning operation, said first driving means is operated and thereafter said second driving means is operated.

9. A cleaning apparatus in combination with a rotating printing cylinder/roller of a printing press, comprising:

a brush roll, pressed against a circumferential surface of said printing cylinder/roller, for scraping contamination therefrom;

a nozzle having a plurality of spray holes for spraying a solvent onto said brush roller;

a diffusing member for diffusing the solvent onto said brush roller by changing a spray direction thereof from the spray holes; and a cleaning cloth, provided below said brush roller, for receiving the contamination scraped by said brush roller;

wherein the contamination scraped by said brush roller is received by the cleaning cloth after the cleaning cloth has contacted the solvent carrying portion of the printing cylinder.

10. An apparatus according to claim 5, wherein when a cleaning operation is started, said cleaning cloth is pressed against the circumferential surface of said printing cylinder/roller after said brush roller is pressed thereagainst, and when the cleaning operation is ended, said cleaning cloth is moved away from the circumferential surface of said printing cylinder/roller after said brush roller is moved away therefrom.

* * * * *

UNITED STATES PATENT AND TRADEMARK OFFICE

CERTIFICATE OF CORRECTION

PATENT NO. : 5,331,891

DATED : July 26,1994

INVENTOR(S) : Sugiyama et al.

It is certified that error appears in the above-identified patent and that said Letters Patent is hereby corrected as shown below:

In column 10 at line 5 change "brush roll mechanism" to --brush roller mechanism--.

Signed and Sealed this

Twenty-fourth Day of October, 1995

Bruce Lehman

*Attest:*

BRUCE LEHMAN

*Attesting Officer*

*Commissioner of Patents and Trademarks*